United States Patent [19]

Puchinger et al.

[11] Patent Number: 4,999,164

[45] Date of Patent: Mar. 12, 1991

[54] PIPETTING DEVICE COMPRISING A RETAINING CONE FOR HOLDING A SLIP-ON PIPETTE TIP AND PIPETTE TIP FOR SUCH PIPETTING DEVICE

[75] Inventors: Herwig Puchinger; Hero Gerken; Günther Kühn, all of Hamburg, Fed. Rep. of Germany

[73] Assignee: Eppendorf-Netheler-Hinz GmbH, Hamburg, Fed. Rep. of Germany

[21] Appl. No.: 111,440

[22] Filed: Oct. 20, 1987

[30] Foreign Application Priority Data

Oct. 20, 1986 [DE] Fed. Rep. of Germany ..... 3635598

[51] Int. Cl.[5] ..... B01L 3/02

[52] U.S. Cl. ..... 422/100; 422/101; 436/54; 436/178; 436/180; 73/864.14; 73/864.15; 73/864.17; 73/864.18; 73/863.23; 73/863.24; 73/863.25

[58] Field of Search ..... 422/61, 100, 101; 436/54, 178, 180; 73/864.14–864.18, 863.23–863.25, 864.01

[56] References Cited

U.S. PATENT DOCUMENTS

| | | | |
|---|---|---|---|
| 3,494,201 | 2/1970 | Roach | 422/100 X |
| 3,985,032 | 10/1976 | Avakian | 73/863.75 |
| 4,059,020 | 11/1977 | Avakian | 73/864.01 X |
| 4,117,728 | 10/1978 | Johnson | 422/100 X |
| 4,267,729 | 5/1981 | Eddelman et al. | 73/425.4 P |
| 4,268,481 | 5/1981 | Suovaniemi et al. | 422/100 |
| 4,283,950 | 8/1981 | Tervamaki | 422/100 X |
| 4,461,328 | 7/1984 | Kenney | 422/100 X |
| 4,483,825 | 11/1984 | Fatches | 422/100 |
| 4,588,555 | 5/1986 | Provonchee | 422/100 X |
| 4,601,212 | 7/1986 | Shapiro | 73/864.18 |
| 4,810,394 | 3/1989 | Masuda | 422/101 X |

FOREIGN PATENT DOCUMENTS

| | | |
|---|---|---|
| 2220135 | 9/1974 | France . |
| 2380059 | 9/1978 | France . |

*Primary Examiner*—Robert J. Warden
*Assistant Examiner*—Lynn M. Kummert
*Attorney, Agent, or Firm*—Toren, McGeady & Associates

[57] ABSTRACT

A pipetting device comprises a retaining cone for holding a slip-on pipette tip and a piston chamber, which communicates with a passage of the retaining cone and contains a reciprocable piston, which acts on the pipette tip that has been fitted on the retaining cone. A filter is provided in the assembly and consists of an aerosol-retaining filter that is detachably mounted in a region which includes the lower end of the pipetting device (1), including the retaining cone (8), as well as the upper end portion of the pipette tip (10) below the retaining cone. The filter may be designed in various ways and may have a progressive filter action. The filter may be arranged in the lower end portion of the retaining cone (8) or in the pipette tip (10) or in an interposed member.

12 Claims, 2 Drawing Sheets

Fig. 1 PRIOR ART
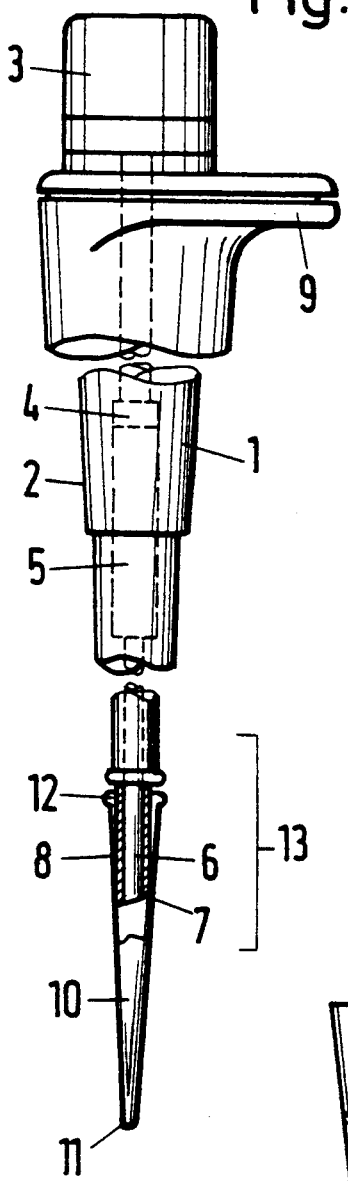
Fig. 2
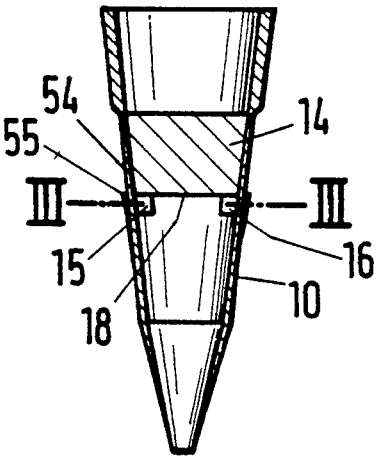
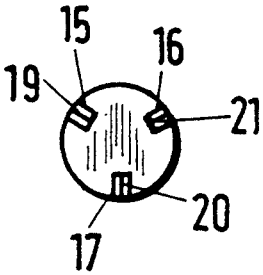
Fig. 3
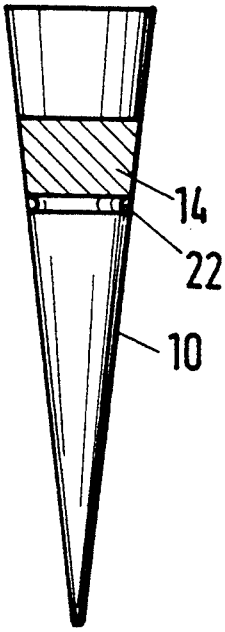
Fig. 4

PIPETTING DEVICE COMPRISING A RETAINING CONE FOR HOLDING A SLIP-ON PIPETTE TIP AND PIPETTE TIP FOR SUCH PIPETTING DEVICE

BACKGROUND OF THE INVENTION

1. Field of the Invention

This invention relates to a pipetting device comprising a retaining cone for holding a slip-on pipette tip and having a piston chamber, which communicates with a passage of the retaining cone and permits a piston to reciprocate in said chamber, also comprising a pipette tip and a filter.

2. Description of the Prior Art

In chemistry and bacteriology it is known to use pipetting means in order to prevent a contact of the mouth of the operator with a liquid which is sucked by the mouth. It is known to provide a separate plug, which is fitted and has capillary through passages for separating cells in liquids It is also known to provide particularly for use with sedimentation measuring tubes a pipetting device which comprises an insert, which is slidably inserted into the top end of a capillary formed in the pipette. That insert opposes the sucking of liquid as far as to a predetermined height and subsequently opposes the further sucking and the return flow of the column of liquid. Plugs made of cotton wool have been used for that purpose and have been inserted into the top end of a pipette in a complicated manner. Because the dimensional stability is low, the length and height of the liquid column cannot be exactly predetermined in that way and it is difficult to remove the plug from the pipette if the latter consists of glass.

German Patent Specification No. 21 55 566 proposes to avoid said disadvantages in that the insert consists of a capillary tube, which fits into the capillary passage of the pipette. The capillary tube has an enlarged head portion, which at its top end contains a filter plug, which presents a high resistance to the flow of liquid but it highly permeable to air. That plug consists of felt, filter material, woven fabric or foam so that it can easily be handled and can be inserted with high accuracy.

German Utility Model No. 1,978,016 proposes that pre-formed filter plugs contained in a magazine can be inserted by means of a push rod into a mouthpiece that is integrally formed on the pipette.

U.S. Pat. No. 4,059,020 discloses filters for use with plastic tips of micropipettes. The filters are made of porous plastic or metal and may be engaged with the pipette tip as the liquid sample is taken so that the latter is filtered at the same time. That filter is only for liquid and is removed when the sample is taken and the filtered liquid is to be dispensed. It has been stated that tips which differ in size and shape may be used. The filter device consists of a holder, which is adapted to be slipped on the pipette tip and contains a filter and has a passage which is cylindrical or conical at the slip-on end so that an adaptation to pipette tips differing in shape is permitted. The porous filter for liquid is aligned with the flow passage and is contained in a filter chamber that is enlarged relative to the flow passage.

U.S. Pat. No. 4,461,328 discloses a pipetting device that comprises one or more pipette tubes, to which a hydrophobic filter paper is secured. That paper restricts the rise of an aqueous liquid in each tube so that a predetermined quantity of liquid may be held in each tube. In a multiple pipette, said filter means permits an exactly predetermined quantity of liquid to be sucked into each pipette tube by the operation of a simple piston means.

Hydrophobic filters used for that purpose are freely permeable to air or other gases but require a relatively high pressure to be applied for a flow of an aqueous liquid into and through the filter. It is also known to use such filters for a filtration of air or for a passage of air from a liquid mass.

Hydrophobic filters may consist of paper or plastic and have porelike passages, which act as capillaries. Typical plastics consist of polytetrafluoroethylene, polyvinylchloride and halogenated fluoroalkali. In the known design the filter is mainly used to restrict the quantity of liquid which can be sucked into pipette tubes whereas a flow of air or other gases for permitting a taking or dispensing of liquid is permitted. The pipetting device specifically consists of a trough, which is provided with a plurality of pipette tubes, on which a common filter sheet is disposed.

In connection with the use with pipettes which are operable by suction, it is also known to protect the operator of the pipette by the provision of an adapter, which is interposed between the pipette and the mouthpiece and has an interior space, which contains a filter membrane having pores which are so small that a passage of bacteria will be prevented.

U.S. Pat. No. 3,995,496 discloses for use with pipettes a mouth-protecting device consisting of a plastic tube, which contains compressed fibers, which constitute a liquid barrier. In contact with a liquid said fibers will expand so that the flow of liquid through the device will be prevented when said liquid is incidentally sucked beyond the end of the pipette. The fibers consist preferably of cotton.

U.S. Pat. No. 4,483,825 discloses a pipette which serves to handle a plasma that has been formed from centrifuged blood. The pipette contains a filter for liquid, which is permeable only to plasma and is impermeable to blood cells.

British Patent Specification No. 1,592,855 discloses a different pipette, which is used, e.g., for handling blood and has a parallel bored passage which contains a porous plug that constitutes a liquid barrier for limiting the sample volume and for moistening the sample in the passage with liquid so that the sample will be maintained in a liquid state. The plug is a dimensionally stable body, which has open pores and which is conical at least before it is inserted into the passage so that its insertion will be facilitated. The plug preferably consists of sintered polyethylene and owing to its conicity is mechanically held in the bore. That design is intended to avoid problems which have arisen with cotton plugs.

SUMMARY OF THE INVENTION

It is an object of the invention to improve a pipetting device which is of the kind described first hereinbefore and may consist of a vessel for mounting a slip-on pipette tip that air flowing through the device will be purified by a removal of aerosols, bacteria, fungi and spores of fungi and in such a manner that the pipetting device in combination with the pipette tip can conveniently be handled so that the filter can be used at a location where it is particularly effective.

That object is accomplished in accordance with the invention in that the filter consists of a filter for retaining aerosols and is detachably mounted in a region which includes the lower end of the pipetting device with the retaining cone and the top end of the pipette tip below the retaining cone. The invention comprises an assembled unit which is generally known per se but the components of which have been modified so that the object will be accomplished in an effective manner. As regards the components which have been modified to accomplish the object the invention relates also to a pipetting device and to a pipette tip per se and to a component which may optionally be used in the unit.

The filter may be effective in two directions so that a contamination of the interior of the pipette above the filter plane will be prevented as well as a back-contamination of the sucked liquid from the upper portion of the interior of the pipette.

The filter may suitably comprise a homogeneous filter material. In another preferred embodiment the filter is a multilayer filter comprising a plurality of superimposed discs for a progressive filter action because the permeability changes, particularly decreases, from disc to disc.

Substantial advantages are afforded by the use of such filter because the flow of liquid is subjected to different influences, which depend on the changing pressure.

From that aspect, a preferred embodiment comprises a plurality of superimposed layers, which differ in density. In that embodiment and in another desirable embodiment the discs differ in height. In the latter embodiment the filter action will depend also on the length of the passages.

A progressive filter action will be suitable because for a filtration of specific substances a filter may be provided which is freely permeable to certain substances whereas substances having different properties will be retained by the filter in steps. In dependence on the nature of the substances to be handled, the filter may be designed for a progressive filtering of specific substances. It is desirable to provide a filter element which has a progressive filter action over the length of the filter and in which individual elements or discs are replaceable. A filter element can then be provided in adaptation to different substances. A suitable pore size lies in the range from 0.2 to 0.45 μm.

In a preferred embodiment, a filter is used which has micropores extending in the direction of flow and consists of a filter element of inorganic material and is used in combination with a filter disc consisting of sintered diatermite guhr. The composition of such an assembly may also be selected for adaptation.

In another desirable embodiment a filter is provided at least in a part with labyrinth-like passages and baffle surfaces and in another part comprises a filter disc which particularly consists of polyester and acetate fibers. Such embodiments are particularly desirable and may alternatively comprise filter discs made of other materials. Coatings may also be used in such arrangements.

In an advantageous embodiment a filter comprises only such labyrinthlike passages and baffle surfaces and said baffle surfaces are constituted by a material which will adhesively react with the substances contained in the fluid flowing through.

In a particularly preferred embodiment the filter assembly or filter comprises a filter material which is coated with specific bactericidal, fungicidal or virucidal actions as well as with substances having a general disinfecting activity.

For use in a special field, a hydrophobic coating may be provided, e.g., in that the filter material has a silanized surface. That feature will provide a desirable filter for aerosols because entrained liquid will be repelled.

In another desirable embodiment the filter material contains baffle surfaces which are constituted by the same material that is coated with a reactive adhesive which will combine with specific components of the fluid flowing through so that they will be retained.

The filter elements which have been described can be used in the pipetting device in various ways.

In a desirable embodiment an interfittable conical filter element is used, which with its larger end is adapted to be fitted on the retaining cone whereas the pipette tip is adapted to be fitted on the smaller end of the filter element, and said interfittable filter element contains a filter. That design will greatly facilitate the manipulation. In that desirable case a selection is possible between two alternatives. In one alternative the interfittable filter element is initially fitted on the retaining cone so that the filter element is incorporated in the pipetting device. In the other alternative the filter element is inserted into the pipette tip, which is thus provided with an additional cone that includes the filter.

For applications in which the filter material can be used repeatedly, the described embodiment with the interfittable filter element will afford the advantage that the conventional pipette tip having no filter insert can be replaced as often as is desired. In that case the conical end portions of the interfittable filter element may be made of a slightly elastic material, particularly of plastic, so that the entire metering system will reliably be sealed in the sampletaking region.

In its intermediate and particularly in its outer portion, but at a distance from its outer end, the interfittable filter element may be provided with a finger-grippable element having a polygonal cross-section. This will facilitate the handling of the device and will permit an improved support of the device in a package or in temporary storage, in another desirable embodiment of the pipetting device the filter is contained in the top end portion of the slip-on pipette tip and the latter is particularly provided with locating means, which change the cross-section. Such locating means will facilitate the exact positioning of the filter material because the same must be spaced a certain minimum distance from the surface of the liquid so that the volumes to be dispensed can exactly be controlled. Such locating means will alter the basic interior shape of the pipette tip.

In a desirable embodiment the locating means comprise inwardly extending projections for supporting a filter plug.

In another embodiment the locating means comprise an inwardly directed annular flange, which supports a filter plug at its lower rim.

In a preferred embodiment the filter comprises a pre-formed plug, which is adhesively fixed in an interfittable filter element or in a pipette tip.

The provision of locating means consisting of projections will afford the advantage that an adaptation of the mounted filter plug will be facilitated because a higher contact pressure which is due to suction or to active pressure will permit the projections to enter the filter plug so that the latter will be more firmly seated on the inside surface of the slip on pipette tip. The locating means and the filters may be dimensioned in such an adaptation to each other that the filter action will not be decreased as the projections enter the filter plug. This can be achieved in that the penetration of the projections will compact the filter material so that the filter action will be increased, or in that the dimensions are so selected that the required filter action will be provided even after a certain deformation.

The projections are preferably provided on their top ridge like a roof. For an improved adaptation of the mounted filter as explained hereinbefore, the projections may be formed with knife edges so that the deformation of the filter will be minimized.

In that connection the interfittable filter element, or in another element the pipette tip may have an elastic wall portion, which can expand as a filter plug element is inserted so that the elastic expansion will ensure a firm mounting and the peripheral lower rim of the expansible wall portion will act also as locating means consisting of an abutment.

In another desirable embodiment of the filter, the latter has the shape of a mushroom having a stem, which is adapted to be slidably inserted into the passage of the retaining cone. Such a filter can also easily be handled because the head of the mushroom-shaped filter can be gripped with the fingers. The stem will then constitute a special filter element, which in view of the foregoing remarks may be composed of a plurality of layers for a progressive filter action.

In one embodiment of the pipetting device the retaining cone is adapted to be opened and comprises a cavity for receiving a filter. In that case the elements of the retaining cone may be provided with releasable connecting means and may define respective portions of the flow passage. In such an arrangement the pipetting device itself is used as a filter carrier and may be provided with conventional pipette tips. Such an arrangement can be used when a large number of pipetting operations can be performed without a replacement of the filter. The inspection will be facilitated if the retaining cone and particularly its receiving top portion or the filter material consist of transparent material. This will permit special conclusions as regards the condition of the substances being handled. In an arrangement in which the filter is accommodated in a retaining cone, connecting means, such as a screw-threaded joint, may be used in combination with an elastic sealing ring so that a quick replacement will be facilitated.

For the same purpose the elements of the retaining cone may be interconnected by a slip-on joint, which may consist of a bayonet joint. In a preferred embodiment the end element of the retaining cone is provided with a conical cuff, which is adapted to be slipped on the other element of the cone.

The provision of a retaining cone made of transparent material will permit an inspection also in order to detect a coloration, as will be explained hereinafter.

In all embodiment the filter may contain an indicator additive consisting, e.g., of a cobalt compound and arranged to be contacted by the liquid. That embodiment will be particularly desirable in a multilayer filter for a progressive filter action because a sudden color change will result in response to a single occurrence of a contamination of the liquid whereas a gradual ingress of aerosols resulting from the taking of a plurality of samples will result in a gradual color change indicating the degree of aerosol loading. In a multilayer filter this result will be obtained by the color change of the indicator in the several layers.

Such coated filter materials must be stored under absolutely dry conditions. For this reason a dry package, possibly consisting of a blister package, may be used in conjunction with these or other coated filter materials and may contain substances for maintaining the contents of the package in a dry condition.

BRIEF DESCRIPTION OF THE DRAWING

FIG. 1 is a diagrammatic side elevation showing partly in section a pipetting device provided with a slip-on tip.

FIG. 2 is a sectional side elevation showing a specially designed slip-on pipette tip with an inserted filter element.

FIG. 3 is a horizontal sectional view taken on line III—III in FIG. 2.

FIG. 4 is a side elevation which is similar to FIG. 2 and shows a different embodiment of a slip-on tip.

DETAILED DESCRIPTION OF THE PREFERRED EMBODIMENTS

Figure 5:
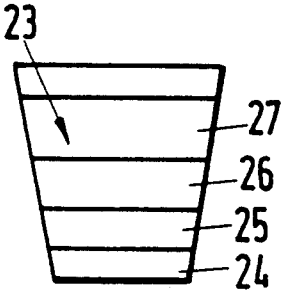
FIGS. 5 to 7 are partly sectional diagrammatic side elevations showing different embodiments of a filter element.

The invention will now be explained with reference to illustrative embodiments shown on the drawing.

In all figures, like parts are designated with like reference characters.

The pipetting device shown in FIG. 1 comprises a body 2, which is, for instance, cylindrical and is provided with an operating lever 3, which extends upwardly out of the body and serves to operate a piston 4 in a cylinder chamber 5. From the chamber 5, a capillary passage 6 extends to the end face 7 of a retaining cone 8. It will be understood that additional guiding and detent means are provided for the operating lever 3 and the piston 4 as well as adjusting means for adjusting different strokes. Said adjusting means may be operable by means of a hand lever 9.

Such pipetting devices are known. Attention is directed in that respect to German Patent Specification No. 25 49 477.

A pipette tip 10 has been slipped on the retaining cone. The pipette tip 10 has an open lower end 11 and at its wider top end is provided on the outside with a reinforcing wall 12 so that a reliable mounting will be ensured if the interfitting portions of the pipette tip 10 and of the retaining cone 8 conform to each other.

A filter is contained in the region 13, which includes the lower end portion of the pipetting device 1, inclusive of the retaining cone, and the top end portion of the pipette tip 10 below the retaining cone.

The filter may be arranged in various ways.

In the embodiment shown in FIGS. 2 and 3 the filter 14 is disposed in the pipette tip 10 and consists of a conical filter plug that conforms to the conical pipette tip 10.

The locating of the filter is defined by locating means.

Two different embodiments of locating means are shown in FIG. 2.

In one of the embodiments shown in FIGS. 2 and 3, the locating means consist of inwardly directed projections 15 to 17, which are engaged by the rim of the bottom surface 18 of the filter plug, possibly under a pressure applied. In a preferred embodiment the projections 15 to 17 are formed at their top with a ridge 19 to 21 like that of a roof. In that case the filter plug can be inserted into sealing contact with the inside surface of the pipette tip in that lower rim portions of the filter plug are forced onto the ridges so that the latter enter the plug and thus define also the position in the peripheral direction. The projections 15 to 17 are preferably narrow and constitute vertical knife blades on which the filter plug can easily be seated under external influences, which may be exerted as the filter plug is inserted or during operation. In that case the filter plugs will be forced down to a larger or smaller depth beyond the knife edges. This is an illustrative embodiment.

It is also apparent from FIG. 2 that the pipette tip 10 comprises a wall portion 54, which has a smaller wall thickness and which is expansible if the pipette tip 10 is made of elastic material. That design will afford the advantage that the insertion of the filter plug will result in an elastic expansion of the walls of the retaining cone so that the filter plug will be firmly seated. The portion 55 of the particularly elastic wall portion 54 will define an abutment for the lower rim of the filter plug so that the insertion of said plug will be limited.

Independently of the above, the inserted filter plug may be held only by frictional contact in the embodiment described last and also in an embodiment comprising a pipette tip having a wall portion of uniform strength.

In the embodiment shown in FIG. 4 the loading means comprise an inwardly directed annular flange 22, which is engageable by the filter plug. It will be understood that in that embodiment the frustoconical filter plug is sufficiently oversize so that it will be in sealing contact with the inside surface of the pipette tip 10 when the filter plug has reached the annular flange.

Figure 6:
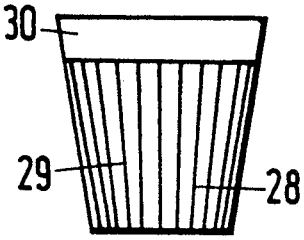
Figure 7:
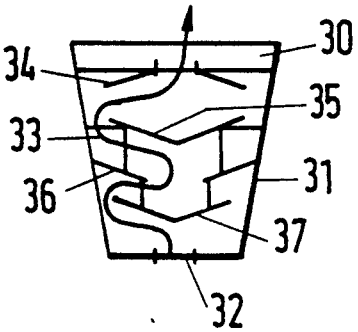

FIGS. 5 to 7 show various embodiments of the filter plug. The illustrated conical shape is desirable for use in the arrangements which are described herein but is not essential.

The filter plug 23 shown in FIG. 5 consists of a plurality of disclike layers 24 to 27. The discs may differ in their filtering characteristics so that a progressive filter action can be obtained. For instances, the discs may be equal in height and may differ in density to provide different filter actions because as the density increases the fluid passing through will more often contact the surfaces which define capillary passages. That fact may be utilized to initiate chemical reactions or may be utilized to provide an increased filter action if the suction or pressure force reaches or exceeds a certain value.

As is apparent from FIG. 5 discs 24 to 27 differ in height. If discs are used which are equal in density, the different heights will result in proportionally different throttling actions or filter actions. Such a design will be preferred if the filter action is to be accompanied by selective influences, which differ in reactive activity in dependence on the height of the individual layers in that a thicker disc will have a higher activity. The dimensions may also be selected with that fact in mind.

Such an embodiment will be preferred if at least individual parts of the filter are provided with a color-changing indicator additive, which is adapted to be contacted by the liquid. In another embodiment the several discs 24 to 27, which may have the same height, may contain different quantities of the indicator additive.

FIG. 6 shows another embodiment of a filter comprising a portion 28 consisting of particularly inorganic material, such as glass fiber material or rock wool, which material has microcapillary passages 29 extending substantially in an axial direction. Such a portion may particularly be used in combination with a filter disc 30 which is made of cellulose or a corresponding plastic, which is preferably non-reactive to the substance to be handled. Owing to its twisted labyrinth-like passages said filter disc may have special filtering characteristics. Reference to the remarks made hereinbefore is made as regards the selection of the material and the pore size.

FIG. 7 shows a similar arrangement comprising an element 31 and a filter disc 30. The element 31 has labyrinthlike passages, which extend from the lower inlet opening 32 and one of which is designated 33. Said passages are defined by baffle surfaces 34 to 37, which may be constituted by a reactive material, such as adhesive coatings, which will combine with specific components of the fluid flowing through so that the latter will be separated from the fluid in addition to the components which are deposited as the flow is deflected. In spite of the provision of the filter disc, the filter will mainly be used to separate aerosols because the filter disc 30 can also be designed in that case for specific reactions in contact with a liquid.

Figure 8:
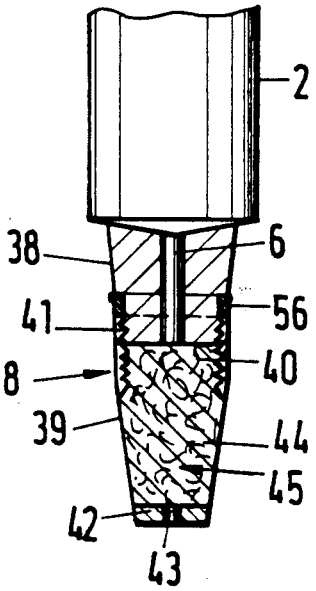
FIG. 8 is a diagrammatic view showing the lower end of a pipetting device provided with a specially designed retaining cone.

In the embodiment shown in FIG. 8 the retaining cone 8 used in FIG. 1 is replaced by a cone consisting of two elements 38 and 39 so that the retaining cone can be taken apart. That element 38 which is secured to the body 2 of the pipetting device is formed in part of its length with the capillary through passage 6 and under an internal transverse partition 40 contains a free space.

The other element 39 of the retaining cone is secured to the element 39 by a screw-threaded joint 41 and consists of a hollow shell, which is closed only at its bottom by the provision of the wall 42 formed with a capillary passage 43. The cavity 44 of the hollow element 39 contains a filter 45 of the described design. That filter is readily replaceable because the lower element 39 of the retaining cone is freely accessible and can be screwed off. In that embodiment, an elastic sealing ring 56 is suitably provided, which permits an assembling with adaptation and stressing. A slipon joint, specifically a bayonet joint, may be used as an alternative.

In the embodiment shown in FIG. 8 a given pipetting device may be used without an alteration together with conventional, known pipette tips.

Figure 9:
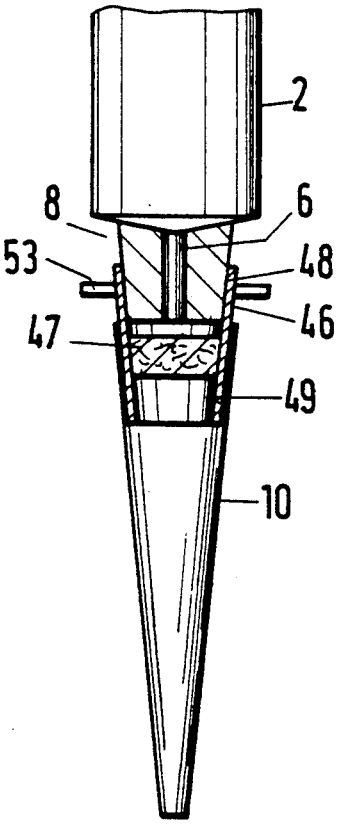
FIG. 9 is a sectional side elevation showing the lower end of a pipetting device comprising a conventional, one-part retaining cone and provided with a pipette tip and an interfitted filter assembly.

Similar remarks are applicable to the embodiment shown in FIG. 9. In that case the manipulation is further facilitated because an interfittable conical filter element 46 can be slipped on the outside surface of the retaining cone 8 and in its interior contains a filter 47.

Owing to the conical shape of the filter element 46, the larger end 48 of said element can readily be fitted on the receiving cone. That larger end portion may be elastic. The pipette tip 10 can be slipped on the outside surface of the smaller lower end 49 because the taper remains the same owing to the described design.

The interfittable filter element 46 is a particularly desirable design for a filter arranged in the region 13 indicated in FIG. 1.

The manipulation of the interfittable filter element can be facilitated by the provision of a finger-grippable flangelike portion 53, which is provided on the outside of the top portion of the filter element and which is suitably polygonal in cross-section.

Figure 10:
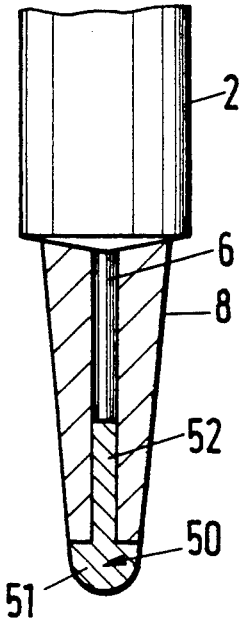
FIG. 10 is a diagrammatic view showing the lower end portion of a conventional pipetting device provided with a specially designed filter.

In the embodiment shown in FIG. 8, the pipetting device 1 and specifically its retaining cone contains a filter 45. Another desirable embodiment is shown in FIG. 10, where a filter 50 is provided on the outside of the tip of the retaining cone 8 rather than in its interior. In that case filter is mushroom-shaped and comprises a particularly hemispherical head 51 having a base which conforms to the lower end of the retaining cone. The filter 50 also comprises a stem 52, which is adapted to be inserted into the capillary passage. Such a filter can easily be handled at its head 51. The stem 52 in itself and the stem 52 and the head 51 may consist of filter materials having different activities. A commercially available pipette tip is mounted on the cone.

The pipette device which has been described will afford essential advantages in use when it is provided with a filter at any of the locations stated.

Airtight packages may be provided for the pipette tip, for the filter or filter material for use in the pipette tip, in the retaining cone or in the interfittable filter element, and for the interfittable filter element, respectively, so that said components will be kept in a sterile, dry condition. The packages may consist of blister packages or of welded film packages.

We claim:

1. A pipetting device, comprising:

a body having an upper end and a lower end and defining a cylinder chamber;

a piston guidable and reciprocable in the cylinder chamber;

means for operating the piston;

a retaining cone arranged at the lower end of and having a capillary passage extending from the cylinder chamber to an end face of the retaining cone;

a pipette tip fitted to the retaining cone and having an open pointed lower end; and an aerosol filter detachably arranged in a region defined by the lower end of the body where the retaining cone is provided and an upper end portion of the pipette tip arranged below the retaining cone, the filter having only labyrinth-like passages and baffle surfaces, the baffle surfaces consisting of a material which adhesively reacts with substances in a fluid flowable through the filter.

2. A pipetting device as set forth in claim 1, wherein the filter has a coating comprising at least one agent having specific bactericidal, fungicidal and virucidal activities, and substances having a general disinfecting activity.

3. A pipetting device as set forth in claim 2, wherein the filter material is provided with a coating that consists of a reactive adhesive for binding specific desired components of a fluid flowable through the device.

4. A pipette device as set forth in claim 3, wherein the filter material has baffle surfaces also provided with an adhesive coating.

5. A pipetting device as set forth in claim 1, and further comprising a conical upstream series filter element disposed between the retaining cone and the pipette tip and having a larger end fittable on the retaining cone and a smaller end on which the pipette tip is mountable, the filter being disposed in said filter element.

6. A pipetting device as set forth in claim 1, wherein the filter is disposed in the upper end portion of the pipette tip, the pipette tip being provided with locating means which changes the cross-section of the tip and consists of inwardly directed projections having roof-shaped crests on upper sides thereof, the locating means defining the position of the filter in the pipette tip.

7. A pipetting device as set forth in claim 5, wherein the filter is adhesively fixed into the filter element.

8. A pipetting device as set forth in claim 1, wherein the filter is mushroom-shaped and has a stem which is slidable into said capillary passage of the retaining cone.

9. A pipetting device as set forth in claim 8, wherein the mushroom-shaped filter has a head which is semispherically shaped so as to form a handle.

10. A pipetting device as set forth in claim 1, wherein the filter is provided with an indicator additive for liquid contact.

11. A pipetting device as set forth in claim 10, wherein the indicator additive includes cobalt compounds so that said additive reacts with a sudden color change to a single occurring contamination of the liquid.

12. A pipetting device as set forth in claim 10, wherein the indicator additive includes cobalt compounds, the indicator additive being provided so as to provide a slow color change for a gradual ingress of aerosols when a plurality of liquid samples are taken.

* * * * *